United States Patent [19]

Martinez

[11] 3,930,396

[45] Jan. 6, 1976

[54] DIE SYSTEM FOR CAN BODY PRESS

[75] Inventor: Everly Martinez, Union City, Calif.

[73] Assignee: Reynolds Metals Company, Richmond, Va.

[22] Filed: Sept. 30, 1974

[21] Appl. No.: 510,386

[52] U.S. Cl. ..... 72/347; 72/467

[51] Int. Cl.[2] ..... B21D 22/20

[58] Field of Search ..... 72/41, 347, 349, 467; 113/120 H

[56] References Cited

UNITED STATES PATENTS

| | | | |
|---|---|---|---|
| 3,577,753 | 5/1971 | Shah | 72/41 |
| 3,685,337 | 8/1972 | Avitzur | 72/347 |
| 3,774,426 | 11/1973 | Jezik | 72/349 |

FOREIGN PATENTS OR APPLICATIONS

| | | | |
|---|---|---|---|
| 625,011 | 6/1949 | United Kingdom | 72/349 |

*Primary Examiner*—Lowell A. Larson

*Attorney, Agent, or Firm*—Glenn, Palmer, Lyne & Gibbs

[57] ABSTRACT

The disclosed ironing ring improvement increases ironing life by use of a conical surface of intermediate taper between the conical lead-in surface and the cylindrical land surface of the ironing ring, particularly for purposes of making drawn and ironed metal can bodies at high speeds.

13 Claims, 3 Drawing Figures

DIE SYSTEM FOR CAN BODY PRESS

BACKGROUND OF THE INVENTION

Drawn and ironed can bodies are conventionally formed while carried on a punch through a set of dies including at least one ironing ring which thins and lengthens the side wall. This operation is repeated through the same set of dies at the rate of more than 100 can bodies per minute. One problem is to supply cooling and lubricating liquid to assist in the ironing operation, and to avoid build-up of aluminum oxide on the ironing ring to the point where it scratches the exterior surface of the can body side wall.

SUMMARY

The present invention improves the operation of conventional ironing rings for aluminum can bodies by introducing a conical surface of intermediate taper between the conical lead-in surface and the cylindrical land surface of the die.

Other details and advantages of the invention will become apparent as the following description of the embodiment thereof in the accompanying drawings proceeds:

DESCRIPTION OF THE DRAWING

The accompanying drawing shows schematically an embodiment of the invention in which.

DESCRIPTION OF THE ILLUSTRATED EMBODIMENT

Figure 1:
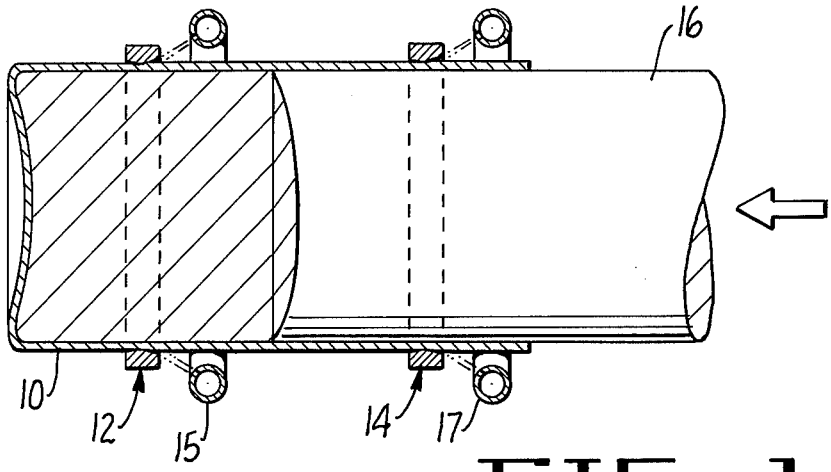
FIG. 1 shows a section, partly broken away, taken through the axis of a punch carrying a can body through a pair of ironing rings.

Referring now more particularly to the drawing, there is shown a can body 10 being carried through a pair of ironing rings 12 and 14 by a punch 16. Annular sprayers 15 and 17 direct cooling and lubricating liquid toward the places where the outer surface of the side wall of can body 10 initially comes in contact with rings 12 and 14. These rings are supported in any suitable manner by means not shown. The rings 12 and 14 are preferably made in substantially the same shape and size so that the ring 12, which has less inside diameter, can be reground after it has becom e worn in use, to the larger inside diameter required for the ring 14. Consequently, what is said below with respect to ring 12, which is illustrated in FIGS. 2 and 3, applies also to ring 14.

Ironing rings of the kind in question are conventionally made of a cobalt and tungsten composition which contains relatively hard grains held in a softer matrix. This matrix is more readily worn away in the course of use than these hard grains. In the case of cans fabricated of aluminum alloys, this wearing action on the ring is accentuated by the naturally occurring presence of aluminum oxide on the outer surface of the aluminum alloy. This oxide apparently tends to dig into the die ring matrix, and then to build up oxide which leaves scratch marks on the outer surface of the can body. The appearance of such scratches limits the effective working life of the ironing ring before it has to be removed for repolishing or regrinding. The present invention is directed to modification of ironing rings so that this problem is minimized and effective ring life is extended. The modification amounts to spreading out the working area over which ironing occurs in the die to avoid having the total work area concentrated at a single point or line.

Figure 2:
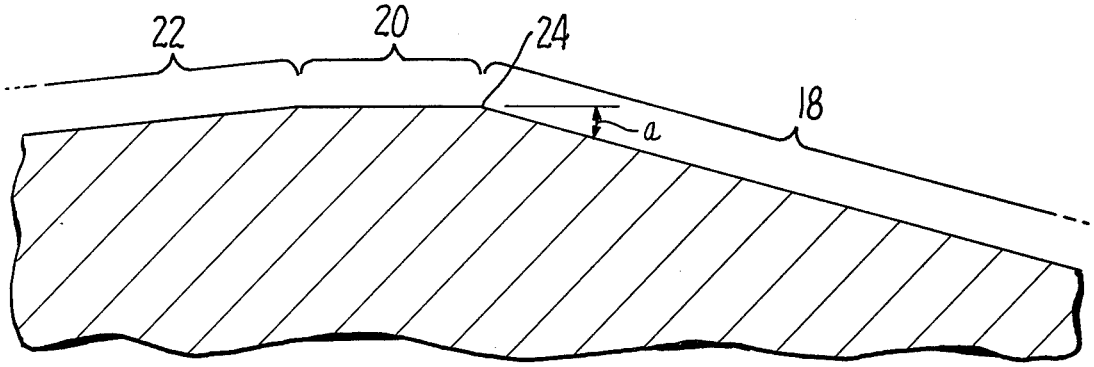
PRIOR ART FIG. 2.
FIG. 2 shows an enlarged sectional view, partly broken away, of the portion of the section of one of the ironing rings shown in FIG. 1, prior to modification in accordance with the invention; and, FIG. 3 shows the section of FIG. 2, after modification in accordance with the invention.
Figure 3:
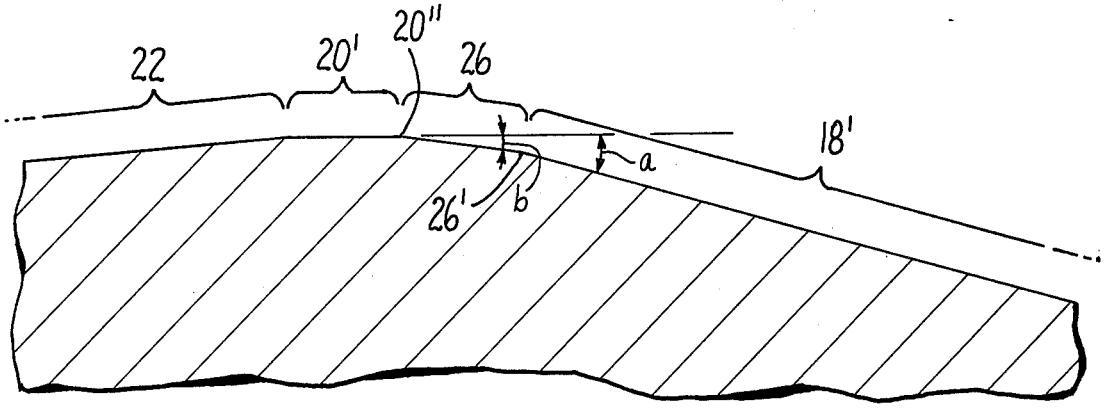

FIG. 2 shows ring 12 in conventional form with a conical lead-in surface 18, a cylindrical land surface 20 and a conical exit surface 22. The circular intersection or lead edge between the lead-in surface 18 and land surface 20 is designated 24.

As referred to herein, semicone angle means the angle between the land surface and a straight line on a conical surface.

The semicone angle of the lead-in surface 18, designated *a*, is subject to two functional considerations. In the first place, it should be small enough to minimize mechanical shock when the can body 10 enters the ring 12 in slightly off-center relation, even through the ring 12 is preferably mounted in a flexible support to permit displacement of the ring 12 to ease such an off-center problem. In the second place, the angle of the conical surface 18 should be large enough to facilitate passage of cooling and lubricating liquid as close as possible to the land surface 20, where the metal of the can body 10 is ironed. The present preferred semicone angle for this purpose is 15°, but the angle may be between 6° and 20°.

The land surface 20 is cylindrical, for purposes of bearing directly against the metal of the side wall of can body 10 to thin and lengthen it. The angle of the conical surface 22 at the exit side of the ironing ring is small and non-critical (e.g., about 6°), enough to clear the can body wall while buttressing the land surface 20.

In accordance with the invention, as seen in FIG. 3, the circular intersection 24 between the cylindrical land surface 20 and the conical inlet surface 18 is replaced by a new intermediate conical surface 26, which has a semicone angle, designated *b*, of between 20 and 80 percent, preferably about 50 percent, of the semicone angle *a* of the lead-in surface 18. With an angle a of 15°, an angle b of 7½° has proved ideal. Depending on the angle *a*, the angle *b* may be in the range of from 2° to 10°. After formation of the surface 26, there remains a cylindrical land surface 20, and a conical lead-in surface 18′ consisting of part of the original lead-in surface 18. The remaining land surface should have a length of 0.007 to 0.012 inch (0.1778 to 0.3048 mm.). The circular intersection or lead edge between the surfaces 18′ and 26 is designated 26′ and the circular intersection or lead edge between the surface 26 and land surface 20′ is designated 20″. Although the surfaces 22, 20′, 26 and 18′ shown in FIG. 3 could each be formed independently of the others, while still maintaining the predetermined angles and axial concentricity with each other, it is preferable to form them by first forming what is shown in FIG. 2. Then, while still holding the ironing ring 12 in the same position in the grinder (such as a Monoset grinder of Cincinnati Milacron Company), adjusting the grinder to the angle required for the surface 26, using the line of intersection 24 to locate where the grinding of surface 26 should begin, and grinding down (in a direction normal to the surface 26) to a depth of between 0.0002 to 0.005 inch (preferably about 0.001 to 0.002 inch). The metric equivalents of these three dimensions are 0.00508 mm., 0.127 mm. and (0.0254 to 0.0508 mm.). This should leave the final cylindrical land 20' with a minimum length of 0.007 to 0.012 inch (0.1778 to 0.3048 mm.), and leave the length of the conical surface 26 at about 0.002 to 0.005 inch (0.0508 to 0.127 mm.), with 0.003 inch (0.0762 mm.) being preferred. The conical surface 18' thus remains as the major surface for guiding the can body 10 into ring 12, and for the purpose of permitting passage of substantial quantities of cooling and lubricating liquid toward the cylindrical surface 20'. The intermediate conical surface 26 is positioned next to the cylindrical land surface 20' to provide a cone of small angle for slidably drawing down the metal of the can body side wall as it passes toward the ironing surface 20'. The resulting operation of the die might be described as making a primary reduction at the lead edge 26' of the surface 26 and a finish reduction at the lead edge 20'' of the land surface 20'. Also, it is believed that the reduced semicone angle of surface 26 aids in the introduction of lubricant between the can body side wall metal and the working face of the ironing die 12 as a result of the two-stage compression of the lubricant by the combined surfaces 18' and 26.

Experience in ironing aluminum can bodies for beer and carbonated beverages at rates over 100 per minute has shown that the above-described modification between what is shown in FIG. 2 and FIG. 3 can in some cases extend the service life of ironing rings by about 50% before repolishing or regrinding is necessary. Typical increased life is from 500,000 cans to 700,000 cans.

While present preferred embodiments of the invention have been illustrated and described, it will be understood that the invention is not limited thereto, but may be otherwise embodied and practiced within the scope of the following claims.

What is claimed is:

1. A press for ironing the side wall of a metal can body, comprising a punch, an ironing ring, means supporting the ironing ring to iron a side wall of a can body carried by the punch as it moves in one direction relative to the ironing ring, means to move the punch relative to the ironing ring, and means to direct cooling and lubricating liquid toward the position where the can body side wall is initially ironed in the ring, said ironing ring having a conical lead-in surface where the can body first enters the ironing ring, a cylindrical land surface adapted to iron and thereby thin and lengthen the can body side wall, and an intermediate conical surface therebetween, the semicone angle of said intermediate conical surface being between 20 and 80 percent of the semicone angle of the conical lead-in surface.

2. Apparatus, according to claim 1, in which the semicone angle of the intermediate conical surface is about half that of the conical lead-in surface.

3. Apparatus, according to claim 2, in which the semicone angle of the conical lead-in surface is about 15°.

4. Apparatus, according to claim 3, in which the semicone angle of the conical intermediate surface is between 2° and 10°.

5. Apparatus, according to claim 1, in which the semicone angle of the conical lead-in surface is between 6° and 20°.

6. Apparatus, according to claim 1, in which the intermediate surface is 0.0002 to 0.005 inch radially inward of the intersection of projections of the conical lead-in surface and the cylindrical land surface.

7. Apparatus, according to claim 6, in which the said radial inward dimension is about 0.001 to 0.002 inch.

8. A method of finishing the surfaces of an ironing ring for making drawn and ironed metal can bodies, comprising the steps of holding the ring stationary while successively grinding a cylindrical land surface on it, grinding a first conical surface on it which intersects the land surface, and grinding a second conical surface between the first two surfaces, said second conical surface having a semicone angle about 20 to 80% of the semicone angle of the said first conical surface, said intermediate surface being ground to a depth of 0.0002 to 0.005 inch from the original intersection of the cylindrical and first conical surfaces.

9. The method of claim 8, in which the semicone angle of the second conical surface is about half that of the first conical surface.

10. A method of ironing the side wall of an aluminum alloy can body, comprising mounting the can body side wall around a punch, and moving the punch through an ironing ring while passing cooling and lubricating fluid toward the place where the can body side wall is initially ironed in the ring, said ironing ring having a conical lead-in surface where the can body first enters the ironing ring, a cylindrical land surface which thins and lengthens the can body side wall, and a conical intermediate surface between said lead-in surface and said land surface, the semicone angle of said concial intermediate surface being between 20 and 80 percent of the semicone angle on the conical lead-in surface.

11. An improved ironing ring for use in a press adapted to make drawn and ironed can bodies, the ironing ring having a cylindrical land surface and a conical lead-in surface, wherein the improvement comprises an intermediate conical surface between the cylindrical land surface and the conical lead-in surface, the semicone angle of the intermediate conical surface being in the range of about 20 to 80 percent of the semicone angle of the conical lead-in surface.

12. The article of claim 11 wherein the semicone angle of the intermediate conical surface is about half of the semicone angle of the conical lead-in surface.

13. The article of claim 12 wherein the semicone angle of the conical lead-in surface is about 15°.

* * * * *